US005681215A

United States Patent [19]

Sherwood et al.

[11] Patent Number: 5,681,215

[45] Date of Patent: Oct. 28, 1997

[54] CARRIER HEAD DESIGN FOR A CHEMICAL MECHANICAL POLISHING APPARATUS

[75] Inventors: Michael T. Sherwood, Fremont; Harry Q. Lee, Mountain View; Norm Shendon, San Carlos; Semyon Spektor, San Francisco, all of Calif.

[73] Assignee: Applied Materials, Inc., Santa Clara, Calif.

[21] Appl. No.: 549,651

[22] Filed: Oct. 27, 1995

[51] Int. Cl.[6] ..... B24B 5/02; B24B 29/02

[52] U.S. Cl. ..... 451/388; 451/288; 451/289; 451/398

[58] Field of Search ..... 279/3; 451/41, 451/256, 254, 286, 288, 289, 290, 388, 398

[56] References Cited

U.S. PATENT DOCUMENTS

| | | | |
|---|---|---|---|
| 3,559,346 | 2/1971 | Paola . | |
| 3,731,435 | 5/1973 | Boettcher et al. . | |
| 4,270,316 | 6/1981 | Kramer et al. . | |
| 4,373,991 | 2/1983 | Banks | 156/645 |
| 4,435,247 | 3/1984 | Basi et al. | 156/636 |
| 4,519,168 | 5/1985 | Cesna . | |
| 4,600,469 | 7/1986 | Fusco et al. | 156/636 |
| 4,944,119 | 7/1990 | Gill, Jr. et al. . | |
| 4,954,142 | 9/1990 | Carr et al. . | |
| 5,081,795 | 1/1992 | Tanaka et al. . | |
| 5,095,661 | 3/1992 | Gill, Jr. et al. . | |
| 5,193,316 | 3/1993 | Olmstead . | |
| 5,205,082 | 4/1993 | Shendon et al. . | |
| 5,230,184 | 7/1993 | Bukhman . | |
| 5,232,875 | 8/1993 | Tuttle et al. | 437/225 |

FOREIGN PATENT DOCUMENTS

WO 94/19153 9/1994 WIPO .

*Primary Examiner*—Timothy V. Eley
*Attorney, Agent, or Firm*—Fish & Richardson, P.C.

[57] ABSTRACT

A carrier uses multiple bellows to form two pressure chambers between the housing and carrier base and retaining ring assembly. By pressurizing the first chamber, an even load can be applied across the substrate. By pressurizing the second chamber, the retaining ring can pressed against the polishing pad. The bellows allow the carrier base to pivot with respect to the housing, but the downward force is evenly applied to the substrate through the first pressure chamber. Torque is transferred from the carrier housing to the carrier base through the bellows.

8 Claims, 10 Drawing Sheets

CARRIER HEAD DESIGN FOR A CHEMICAL MECHANICAL POLISHING APPARATUS

CROSS REFERENCE TO RELATED APPLICATIONS

This application is related to pending concurrently filed U.S. application Ser. No. 08/549,336 entitled CONTINUOUS PROCESSING SYSTEM FOR CHEMICAL MECHANICAL POLISHING, and assigned to the assignee of the present application. The entire disclosure of that application is hereby incorporated by reference.

BACKGROUND OF THE INVENTION

The invention relates to chemical mechanical polishing of substrates, and more particularly to a carrier head for a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes successively more non-planar. This occurs because the distance between the outer surface and the underlying substrate is greatest in regions of the substrate where the least etching has occurred, and least in regions where the greatest etching has occurred. With a single patterned underlying layer, this non-planar surface comprises a series of peaks and valleys wherein the distance between the highest peak and the lowest valley may be the order of 7000 to 10,000 Angstroms. With multiple patterned underlying layers, the height difference between the peaks and valleys becomes even more severe, and can reach several microns.

This non-planar outer surface presents a problem for the integrated circuit manufacturer. If the outer surface is non-planar, then photolithographic techniques to pattern photoresist layers might not be suitable, as a non-planar surface can prevent proper focusing of the photolithography apparatus. Therefore, there is a need to periodically planarize this substrate surface to provide a planar layer surface. Planarization, in effect, polishes away a non-planar, outer surface, whether a conductive, semiconductive, or insulative layer, to form a relatively flat, smooth surface. Following planarization, additional layers may be deposited on the outer layer to form interconnect lines between features, or the outer layer may be etched to form vias to lower features.

Chemical mechanical polishing is one accepted method of planarization. This planarization method typically requires that the substrate be mounted on a carrier or polishing head, with the surface of the substrate to be polished exposed. The substrate is then placed against a rotating polishing pad. In addition, the carrier head may rotate to provide additional motion between the substrate and polishing surface. Further, a polishing slurry, including an abrasive and at least one chemically-reactive agent, may be spread on the polishing pad to provide an abrasive chemical solution at the interface between the pad and substrate.

Important factors in the chemical mechanical polishing process are: the finish (roughness) and flatness (lack of large scale topography) of the substrate surface, and the polishing rate. Inadequate flatness and finish can produce substrate defects. The polishing rate sets the time needed to polish a layer. Thus, it sets the maximum throughput of the polishing apparatus.

Each polishing pad provides a surface which, in combination with the specific slurry mixture, can provide specific polishing characteristics. Thus, for any material being polished, the pad and slurry combination is theoretically capable of providing a specified finish and flatness on the polished surface. The pad and slurry combination can provide this finish and flatness in a specified polishing time. Additional factors, such as the relative speed between the substrate and pad, and the force pressing the substrate against the pad, affect the polishing rate, finish and flatness.

Because inadequate flatness and finish can create defective substrates, the selection of a polishing pad and slurry combination is usually dictated by the required finish and flatness. Given these constraints, the polishing time needed to achieve the required finish and flatness sets the maximum throughput of the polishing apparatus.

An additional limitation on polishing throughput is "glazing" of the polishing pad. Glazing occurs when the polishing pad is heated and compressed in regions where the substrate is pressed against it. The peaks of the polishing pad are pressed down and the pits of the polishing pad are filled up, so the surface of the polishing pad becomes smoother and less abrasive. As a result, the polishing time required to polish a substrate increases. Therefore, the polishing pad surface must be periodically returned to an abrasive condition, or "conditioned", to maintain a high throughput.

An additional consideration in the production of integrated circuits is process and product stability. To achieve a low defect rate, each successive substrate should be polished under similar conditions. Each substrate should be polished by approximately the same amount so that each integrated circuit is substantially identical.

In view of the foregoing, there is a need for a chemical mechanical polishing apparatus which optimizes polishing throughput, flatness, and finish, while minimizing the risk of contamination or destruction of any substrate.

Specifically, there is a need for a carrier head that provides a substantially uniform pressure across the substrate surface being polished. The carrier head should be able to stay substantially parallel to the polishing pad. In addition, the carrier head should have an independently loadable retaining ring to restrain the substrate.

Additional advantages of the invention will be set forth in the description which follows, and in part will be obvious from the description, or may be learned by practice of the invention. The advantages of the invention may be realized by means of the instrumentalities and combinations particularly pointed out in the claims.

SUMMARY OF THE INVENTION

One embodiment of the present invention is a carrier head for a chemical mechanical polishing apparatus. The carrier head has a housing connected to a drive shaft, a base with a surface to hold a substrate against a polishing pad, and a retaining ring to hold the substrate beneath the base. The carrier head also includes a plurality of bellows. The bellows connect the base to the housing to form a first chamber therebetween. The bellows also connect the retaining ring to the housing to form a second chamber therebetween. The housing rotates with the drive shaft about a first axis.

The bellows may comprise a first and a second bellows connecting the base to the housing, and a third and a fourth bellows connecting the retaining ring to the housing. The base may include a first surface to catch against a second surface on the housing to prevent over-extension of at least some of the bellows. A projection from the base may fit into a cavity in the housing. The bellows may form a third chamber between the base and the housing. The base may include a passage connecting the surface to the third chamber. A flexible seal may connect the base to the retaining ring.

BRIEF DESCRIPTION OF THE DRAWINGS

The accompanying drawings, which are incorporated in and constitute a part of the specification, schematically illustrate a preferred embodiment of the invention, and together with the general description given above and the detailed description of the preferred embodiment given below, serve to explain the principles of the invention.

DESCRIPTION OF THE PREFERRED EMBODIMENT(S)

Figure 1A:
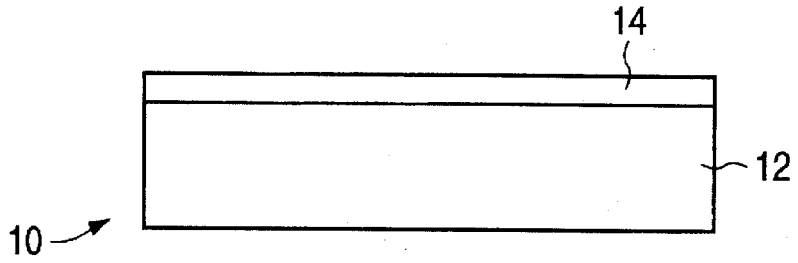
FIGS. 1A–1E are schematic diagrams illustrating the deposition and etching of a layer on a substrate.
Figure 1B:
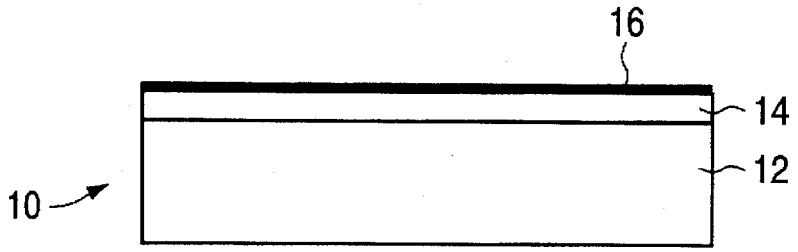
Figure 1C:
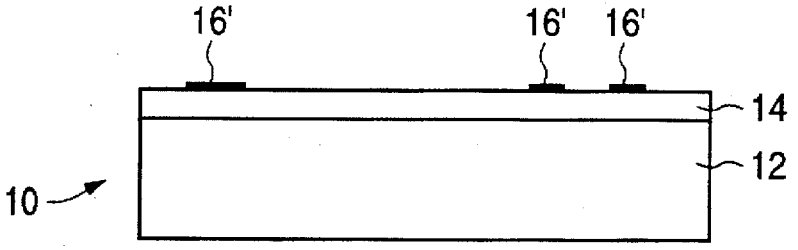
Figure 1D:
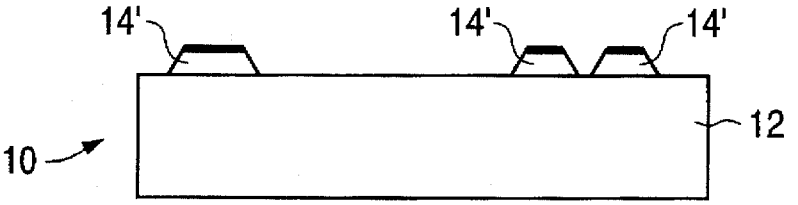
Figure 1E:
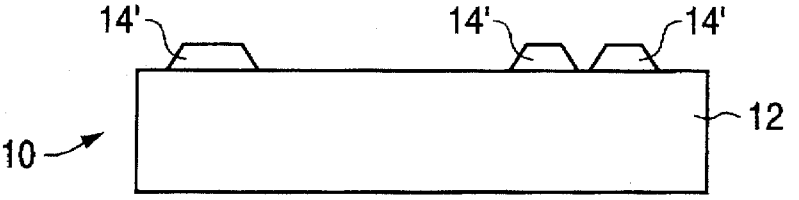

FIGS. 1A–1E illustrate the process of depositing a layer onto a planar surface of a substrate. As shown in FIG. 1A, a substrate 10 might be processed by coating a flat semiconductive silicon wafer 12 with a metal layer 14, such as aluminum. Then, as shown in FIG. 1B, a layer of photoresist 16 may be placed on metal layer 14. Photoresist layer 16 can then be exposed to a light image, as discussed in more detail below, producing a patterned photoresist layer 16' shown in FIG. 1C. As shown in FIG. 1D, after patterned photoresist layer 16' is created, the exposed portions of metal layer 14 are etched to create metal islands 14'. Finally, as shown in FIG. 1E, the remaining photoresist is removed.

Figure 2A:
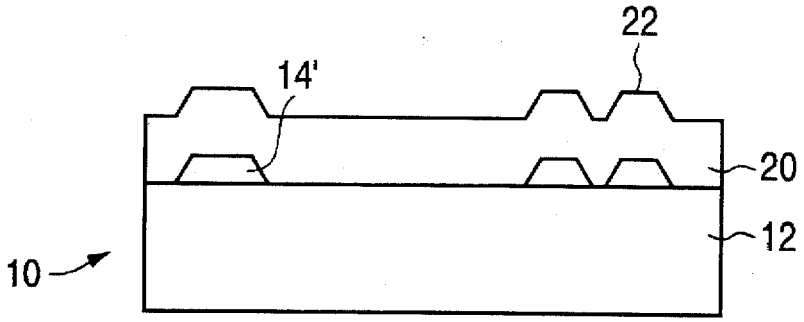
FIGS. 2A–2C are schematic diagrams illustrating the polishing of a non-planar outer surface of a substrate.
Figure 2B:
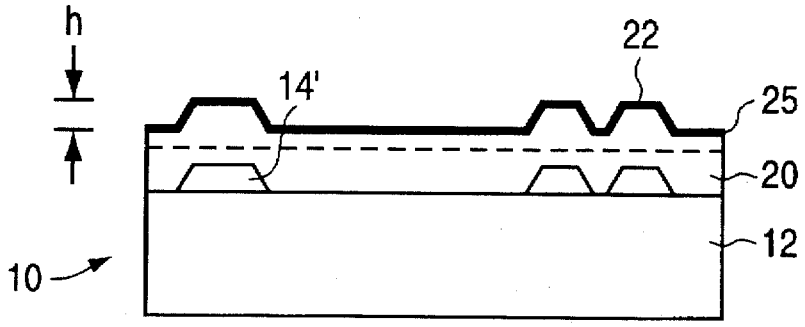

FIGS. 2A–2B illustrate the difficulty presented by deposition of subsequent layers on a substrate. As shown in FIG. 2A, an insulative layer 20, such as silicon dioxide, may be deposited over metal islands 14'. The outer surface 22 of insulative layer 20 almost exactly replicates the underlying structures of the metal islands, creating a series of peaks and valleys so outer surface 22 is non-planar. An even more complicated outer surface would be generated by depositing and etching multiple layers on an underlying patterned layer.

If, as shown in FIG. 2B, outer surface 22 of substrate 10 is non-planar, then a photoresist layer 25 placed thereon is also non-planar. A photoresist layer is typically patterned by a photolithographic apparatus that focuses a light image onto the photoresist. Such an imaging apparatus typically has a depth of focus of about 0.2 to 0.4 microns for sub-halfmicron feature sizes. If the photoresist layer 25 is sufficiently non-planar, that is, if the maximum height difference h between a peak and valley of outer surface 22 is greater than the depth of focus of the imaging apparatus, then it will be impossible to properly focus the light image onto the entire surface 22. Even if the imaging apparatus can accommodate the non-planarity created by a single underlying patterned layer, after the deposition of a sufficient number of patterned layers, the maximum height difference will exceed the depth of focus.

It may be prohibitively expensive to design new photolithographic devices having an improved depth of a focus. In addition, as the feature size used in integrated circuits becomes smaller, shorter wavelengths of light must be used, resulting in further reduction of the available depth of focus.

Figure 2C:
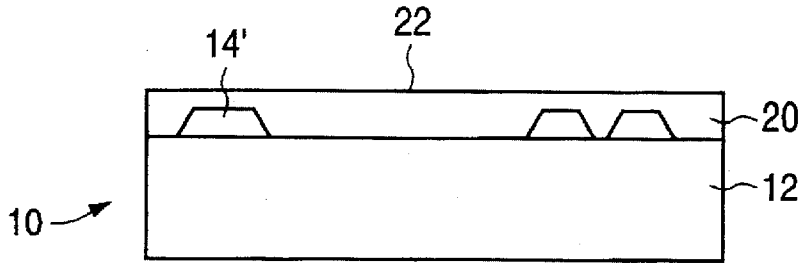

A solution, as shown in FIG. 2C, is to planarize the outer surface. Planarization wears away the outer surface, whether metal, semiconductive, or insulative, to form a substantially smooth, flat outer surface 22. As such, the photolithographic apparatus can be properly focused. Planarization could be performed only when necessary to prevent the peak-to-valley difference from exceeding the depth of focus, or planarization could be performed each time a new layer is deposited over a patterned layer.

Polishing may be performed on metallic, semiconductive, or insulative layers. The particular reactive agents, abrasive particles, and catalysts will differ depending on the surface being polishing. The present invention is applicable to polishing of any of the above layers.

Figure 3:
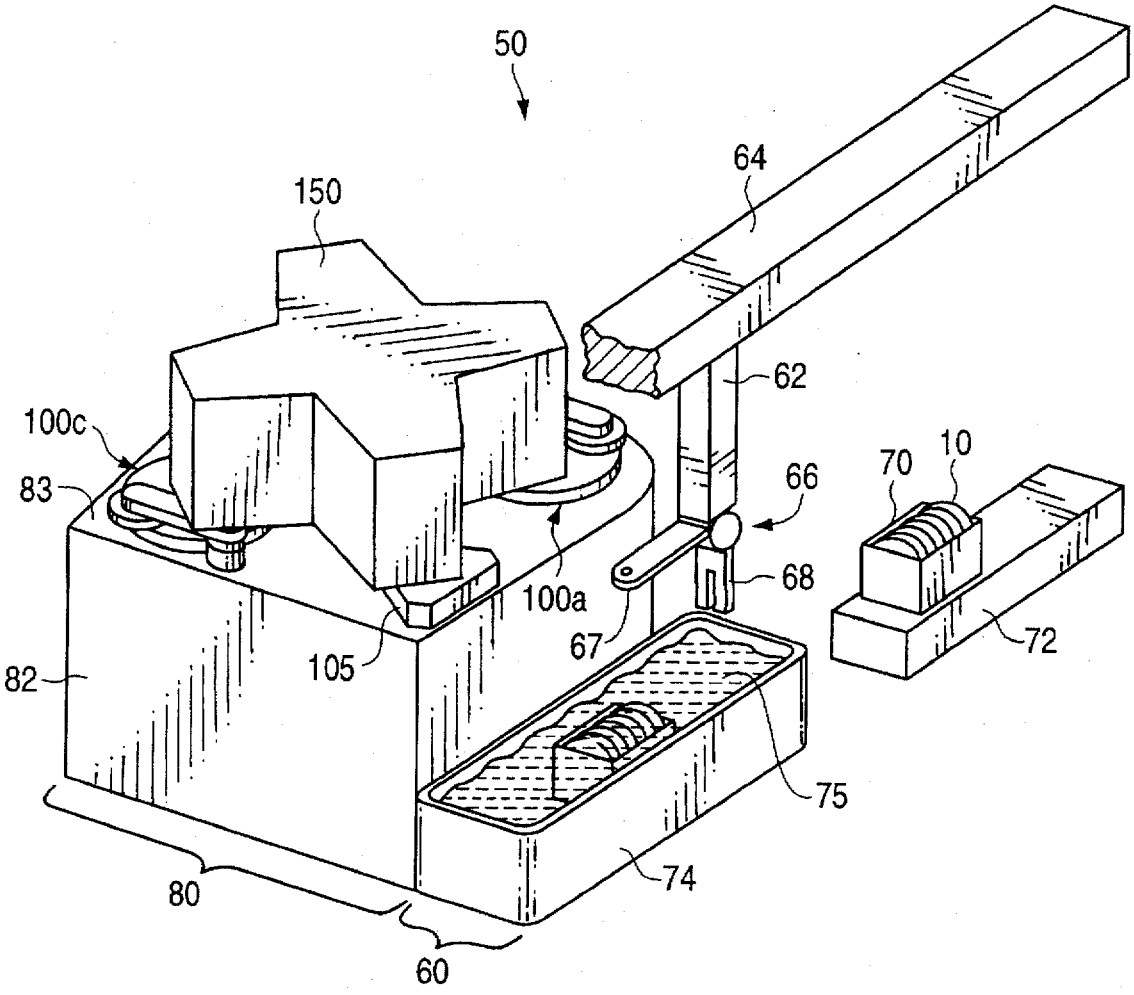
FIG. 3 is a schematic perspective view of a chemical mechanical polishing apparatus.

As shown in FIG. 3, a chemical mechanical polishing system 50 according to the present invention includes a loading apparatus 60 adjacent to a polishing apparatus 80. Loading apparatus 60 includes a rotatable, extendable arm 62 hanging from an overhead track 64. In the figure, overhead track 64 has been partially cut-away to more clearly show polishing apparatus 80. Arm 62 ends in a wrist assembly 66 which includes a blade 67 with a vacuum port and a cassette claw 68.

Substrates 10 are brought to polishing system 50 in a cassette 70 and placed on a holding station 72 or directly into a tub 74. Cassette claw 68 on arm 64 may be used to grasp cassette 70 and move it from holding station 72 to tub 74. Tub 74 is filled with a liquid bath 75, such as deionized water. Blade 67 fastens to an individual substrate from cassette 70 in tub 74 by vacuum suction, removes the substrate from cassette 70, and loads the substrate into polishing apparatus 80. Once polishing apparatus 80 has completed polishing the substrate, blade 67 returns the substrate to the same cassette 70 or to a different one. Once all of the substrates in cassette 70 are polished, claw 68 may remove cassette 70 from tub 74 and return the cassette to holding station 72.

Figure 4:
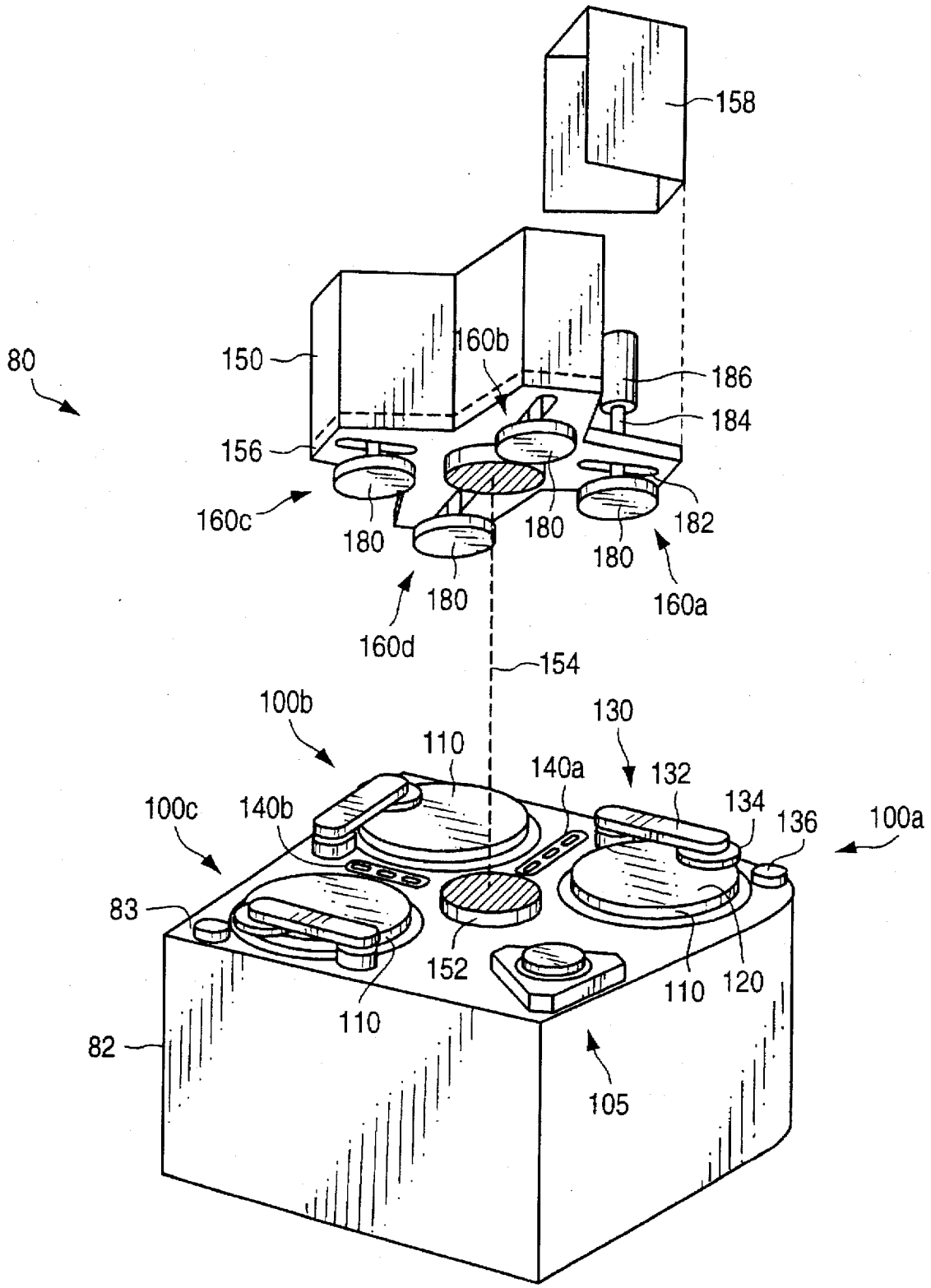
FIG. 4 is a schematic exploded perspective view of the chemical mechanical polishing apparatus of FIG. 3.

Polishing apparatus 80 includes a lower machine base 82 with a table top 83 mounted thereon and a removable upper outer cover (not shown). As best seen in FIG. 4, table top 83 supports a series of polishing stations **100*a*, 100*b* and 100*c*, and a transfer station 105. Transfer station 105 forms a generally square arrangement with the three polishing stations 100*a*, 100*b* and 100*c*. Transfer station 105 serves multiple functions of receiving individual substrates 10 from loading apparatus 60, washing the substrates, loading the substrates into carrier heads (to be described below), receiving the substrates from the carrier heads, washing the substrates again, and finally transferring the substrates back to loading apparatus 60** which returns the substrates to the cassette.

Each polishing station **100*a*, 100*b*, or 100*c* includes a rotatable platen 110 on which is placed a polishing pad 120**.

Each polishing station 100*a*, 100*b* and 100*c* may further include an associated pad conditioner apparatus 130. Each pad conditioner apparatus 130 has a rotatable arm 132 holding an independently rotating conditioner head 134 and an associated washing basin 136. The conditioner apparatus maintains the condition of the polishing pad so it will effectively polish any substrate pressed against it while it is rotating.

Two or more intermediate washing stations 140*a* and 140*b* are positioned between neighboring polishing stations 100*a*, 100*b*, 100*c* and transfer station 105. The washing stations rinse the substrates as they pass from one polishing station to another.

A rotatable multi-head carousel 150 is positioned above lower machine base 82. Carousel 150 is supported by a center post 152 and rotated thereon about a carousel axis 154 by a carousel motor assembly located within base 82. Center post 152 supports a carousel support plate 156 and a cover 158. Multi-head carousel 150 includes four carrier head systems 160*a*, 160*b*, 160*c*, and 160*d*. Three of the carrier head systems receive and hold a substrate, and polish it by pressing it against the polishing pad 120 on platen 110 of polishing stations 100*a*, 100*b* and 100*c*. One of the carrier head systems receives substrates from and delivers substrates to transfer station 105.

In the preferred embodiment, the four carrier head systems 160*a*–160*d* are mounted on carousel support plate 156 at equal angular intervals about carousel axis 154. Center post 152 supports carousel support plate 156 and allows the carousel motor to rotate the carousel support plate 156 and to orbit the carrier head systems 160*a*–160*d*, and the substrates attached thereto, about carousel axis 154.

Each carrier head system 160*a*–160*d* includes a polishing or carrier head 180. Each carrier head 180 independently rotates about its own axis, and independently laterally oscillates in a radial slot 182 formed in support plate 156. A carrier drive shaft 184 connects a carrier head rotation motor 186 to carrier head 180 (shown by the removal of one-quarter of cover 158). There is one carrier drive shaft and motor for each head.

The substrates attached to the bottom of carrier heads 180 may be raised or lowered by the polishing head systems 160*a*–160*d*. An advantage of the overall carousel system is that only a short vertical stroke is required of the polishing head systems to accept substrates, and position them for polishing and washing. An input control signal (e.g., a pneumatic, hydraulic, or electrical signal), causes expansion or contraction of carrier head 180 of the polishing head systems in order to accommodate any required vertical stroke. Specifically, the input control signal causes a lower carrier member having a wafer receiving recess to move vertically relative to a stationary upper carrier member.

During actual polishing, three of the carrier heads, e.g., those of polishing head systems 160*a*–160*c*, are positioned at and above respective polishing stations 100*a*–100*c*. Each rotatable platen 110 supports a polishing pad 120 with a top surface which is wetted with an abrasive slurry. Carrier head 180 lowers a substrate to contact polishing pad 120, and the abrasive slurry acts as the media for both chemically and mechanically polishing the substrate or wafer.

After each substrate is polished, polishing pad 120 is conditioned by conditioning apparatus 130. Arm 132 sweeps conditioner head 134 across polishing pad 120 in an oscillatory motion generally between the center of polishing pad 120 and its perimeter. Conditioner head 134 includes an abrasive surface, such as a nickel-coated diamond surface. The abrasive surface of conditioner head 134 is pressed against rotating polishing pad 120 to abrade and condition the pad.

In use, the polishing head 180, for example, that of the fourth carrier head system 160*d*, is initially positioned above the wafer transfer station 105. When the carousel 150 is rotated, it positions different carrier head systems 160*a*, 160*b*, 160*c*, and 160*d* over the polishing stations 100*a*, 100*b* and 100*c*, and the transfer station 105. The carousel 150 allows each polishing head system to be sequentially located, first over the transfer station 105, and then over one or more of the polishing stations 100*a*–100*c*, and then back to the transfer station 105.

Figure 5A:
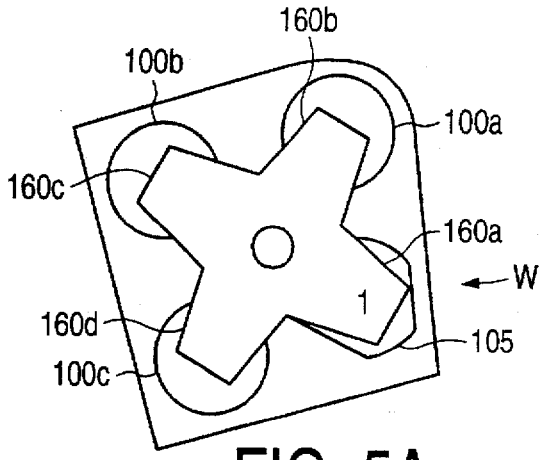
FIGS. 5A–5F are schematic top views of the polishing apparatus illustrating the progressive movement of wafers as they are sequentially loaded and polished.
Figure 5B:
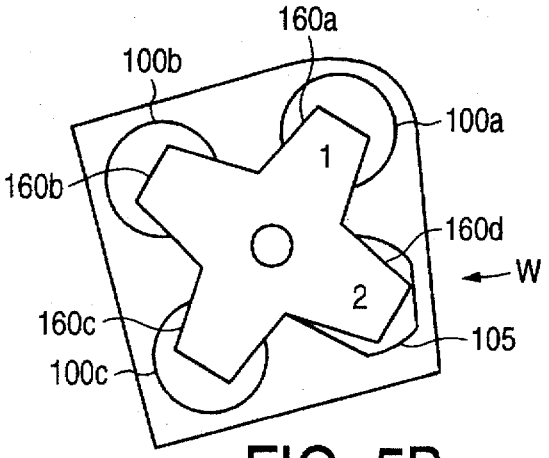
Figure 5C:
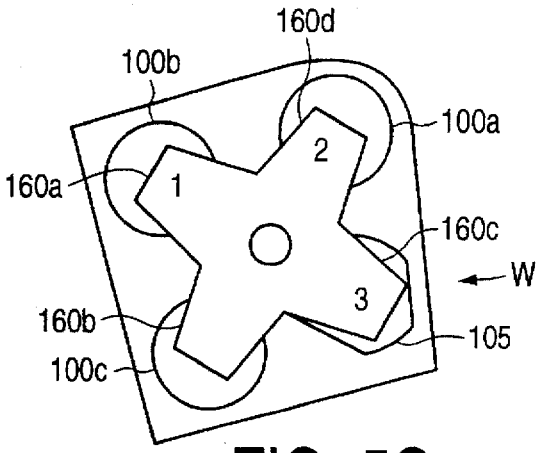
Figure 5D:
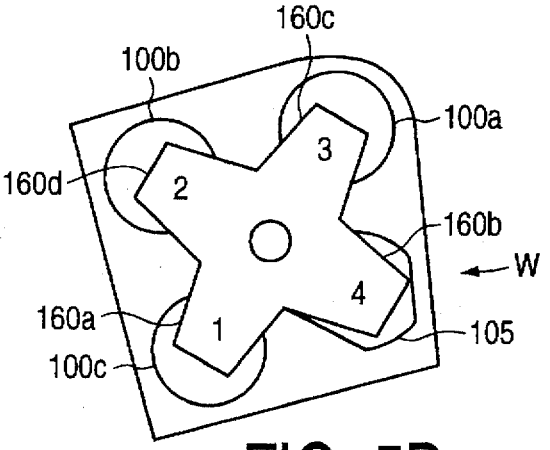
Figure 5E:
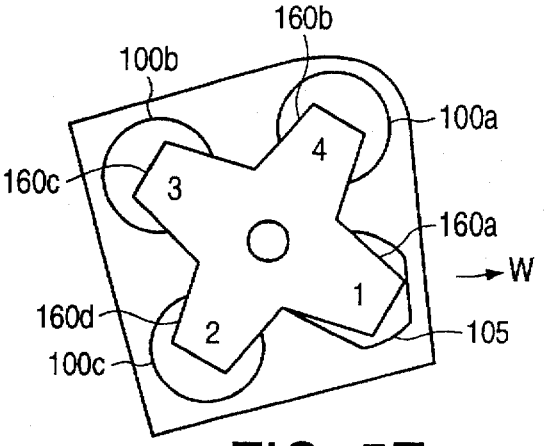
Figure 5F:
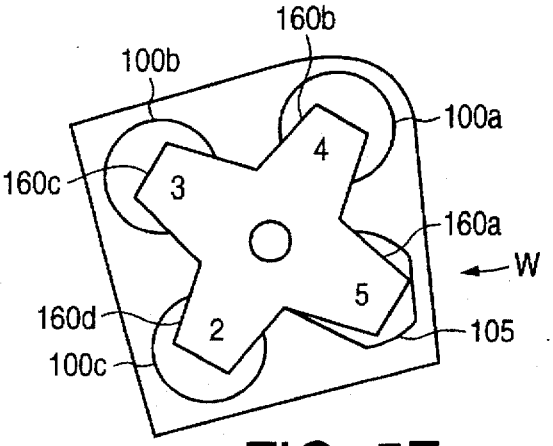

FIGS. 5A–5F show the carrousel 150 and its movement with respect to the insertion of a substrate such as a wafer (W) and subsequent movement of carrier head systems 160*a*–160*d*. As shown in FIG. 5A, a first wafer W#1 is loaded from loading apparatus 60 into transfer station 105, where the wafer is washed and then loaded into a carrier head 180, e.g., that of a first carrier head system 160*a*. Carousel 150 is then rotated counter-clockwise on supporting center post 152 so that, as shown in FIG. 5B, first carrier head system 160*a* with wafer W#1 is positioned at the first polishing station 100*a*, which performs a first polish of wafer W#1. While first polishing station 100*a* is polishing wafer W#1, a second wafer W#2 is loaded from loading apparatus 60 to transfer station 105 and from there to a second carrier head system 160*b*, now positioned over transfer station 105. Then carousel 150 is again rotated counter-clockwise by 90° so that, as shown in FIG. 5C, first wafer W#1 is positioned over second polishing station 100*b* and second wafer W#2 is positioned over first polishing station 100*a*. A third carrier head system 100*c* is positioned over transfer station 105, from which it receives a third wafer W#3 from loading system 60. In a preferred embodiment, during the stage shown in FIG. 5C, wafer W#1 at second polishing station 100*b* is polished with a slurry of finer grit than wafer W#1 at the first polishing station 100*a*. In the next stage, as illustrated by FIG. 5D, carousel 150 is again rotated counter-clockwise by 90° so as to position wafer W#1 over third polishing station 100*c*, wafer W#2 over second polishing station 100*c*, and wafer W#3 over first polishing station 100*a*, while a fourth carrier head system 160*d* receives a fourth wafer W#4 from loading apparatus 60. The polishing at third polishing station 100*c* is presumed to be even finer than that of second polishing station 100*b*. After the completion of this stage, carousel 150 is again rotated. However, rather than rotating it counter-clockwise by 90°, carousel 150 is rotated clockwise by 270°. By avoiding continuous rotation in one direction, carousel 150 may use simple flexible fluid and electrical connections rather than complex rotary couplings. The rotation, as shown in FIG. 5E, places wafer W#1 over transfer station 105, wafer W#2 over third polishing station 100*c*, wafer W#3 over second polishing station 100*b*, and wafer W#4 over first polishing station 100*a*. While wafers W#1–W#3 are being polished, wafer W#1 is washed at transfer station 105 and returned from carrier head system 160*a* to loading apparatus 60. Finally, as illustrated by FIG. 5F, a fifth wafer W#5 is loaded into first carrier head system 160*a*. After this stage, the process is repeated.

Figure 6:
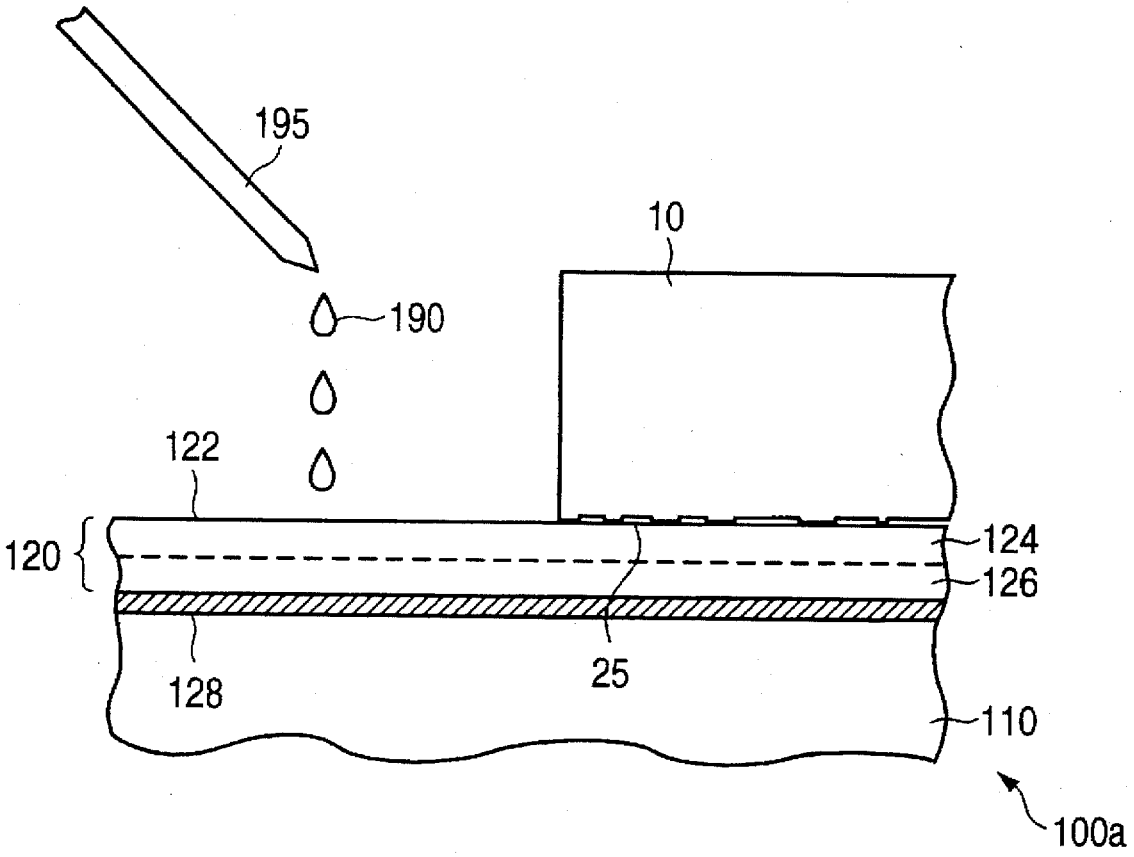
FIG. 6 is a schematic side view of a substrate on a polishing pad.

As shown in FIG. 6, a carrier head system, such as system 160*a*, lowers substrate 10 to engage a polishing station, such as polishing station 100*a*. As noted, each polishing station includes a rigid platen 110 supporting a polishing pad 120. If substrate 10, is an eight-inch (200 mm) diameter disk, then platen 110 and polishing pad 120 will be about twenty inches in diameter. Platen 110 is preferably a rotatable aluminum or stainless steel plate connected by stainless steel platen drive shaft (not shown) to a platen drive motor (not shown). For most polishing processes, the drive motor rotates platen 120 at thirty to two-hundred revolutions per minute, although lower or higher rotational speeds may be used.

Polishing pad 120 is a hard composite material with a roughened surface 122. Polishing pad 120 may have a fifty mil thick hard upper layer 124 and a fifty mil thick softer lower layer 126. Upper layer 124 is preferably a material composed of polyurethane mixed with other fillers. Lower layer 126 is preferably a material composed of compressed felt fibers leached with urethane. A common two-layer polishing pad, with the upper layer composed of IC-1000 and the lower layer composed of SUBA-4, is available from Rodel, Inc., located in Newark, Del. (IC-1000 and SUBA-4 are product names of Rodel, Inc.). In one embodiment, polishing pad 120 is attached to platen 110 by a pressure-sensitive adhesive layer 128.

Each carrier head system includes a rotatable carrier head. The carrier head holds substrate 10 with the top surface 22 pressed face down against outer surface 122 of polishing pad 120. For the main polishing step, usually performed at station 100*a*, carrier head 180 applies a force of approximately four to ten pounds per square inch (psi) to substrate 10. At subsequent stations, carried head 180 may apply more or less force. For example, for a final polishing step, usually performed at station 100*c*, carrier head 180 applies about three psi. Carrier drive motor 186 (see FIG. 4) rotates carrier head 180 at about thirty to two-hundred revolutions per minute. In a preferred embodiment, platen 110 and carrier head 180 rotate at substantially the same rate.

A slurry 190 containing a reactive agent (e.g., deionized water for oxide polishing), abrasive particles (e.g., silicon dioxide for oxide polishing) and a chemically reactive catalyzer (e.g., potassium hydroxide for oxide polishing), is supplied to the surface of polishing pad 120 by a slurry supply tube 195. Sufficient slurry is provided to cover and wet the entire polishing pad 120.

Chemical mechanical polishing is a fairly complex process, and differs from simple wet sanding. In a polishing process a reactive agent in slurry 190 reacts with surface 22 of top layer 20, which may be a conductive, semiconductive, or insulative layer, and with the abrasive particles to form reactive sites. The interaction of the polishing pad, abrasive particles, and reactive agent with the substrate results in polishing.

Figure 7:
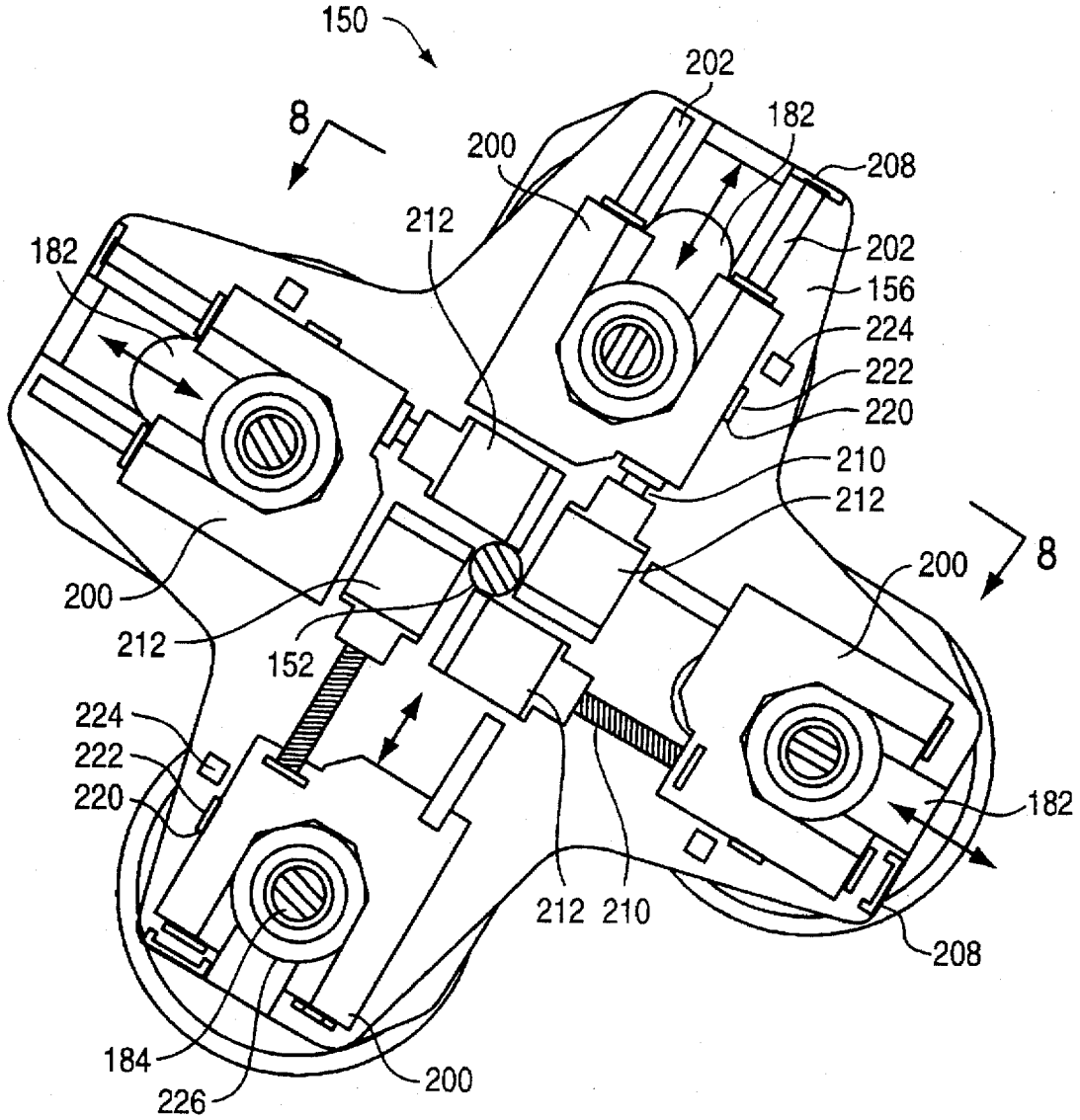
FIG. 7 is a schematic top view of a carousel, with the upper housing removed.

As shown in FIG. 7, in which cover 158 of carousel 150 has been removed, carousel support plate 156 supports the four carrier head systems 160*a*–160*d*. Carousel support plate includes four slots 182, generally extending radially and oriented 90° apart. Slots 182 may either be close-ended (as shown) or open-ended. The top of support plate 156 supports four slotted carrier head support slides 200. Each slide 200 aligns along one of the slots 182 and moves freely along a radial path with respect to support plate 156. Two linear bearing assemblies 201 bracket each slot 182 to support each slide 200.

Figure 8:
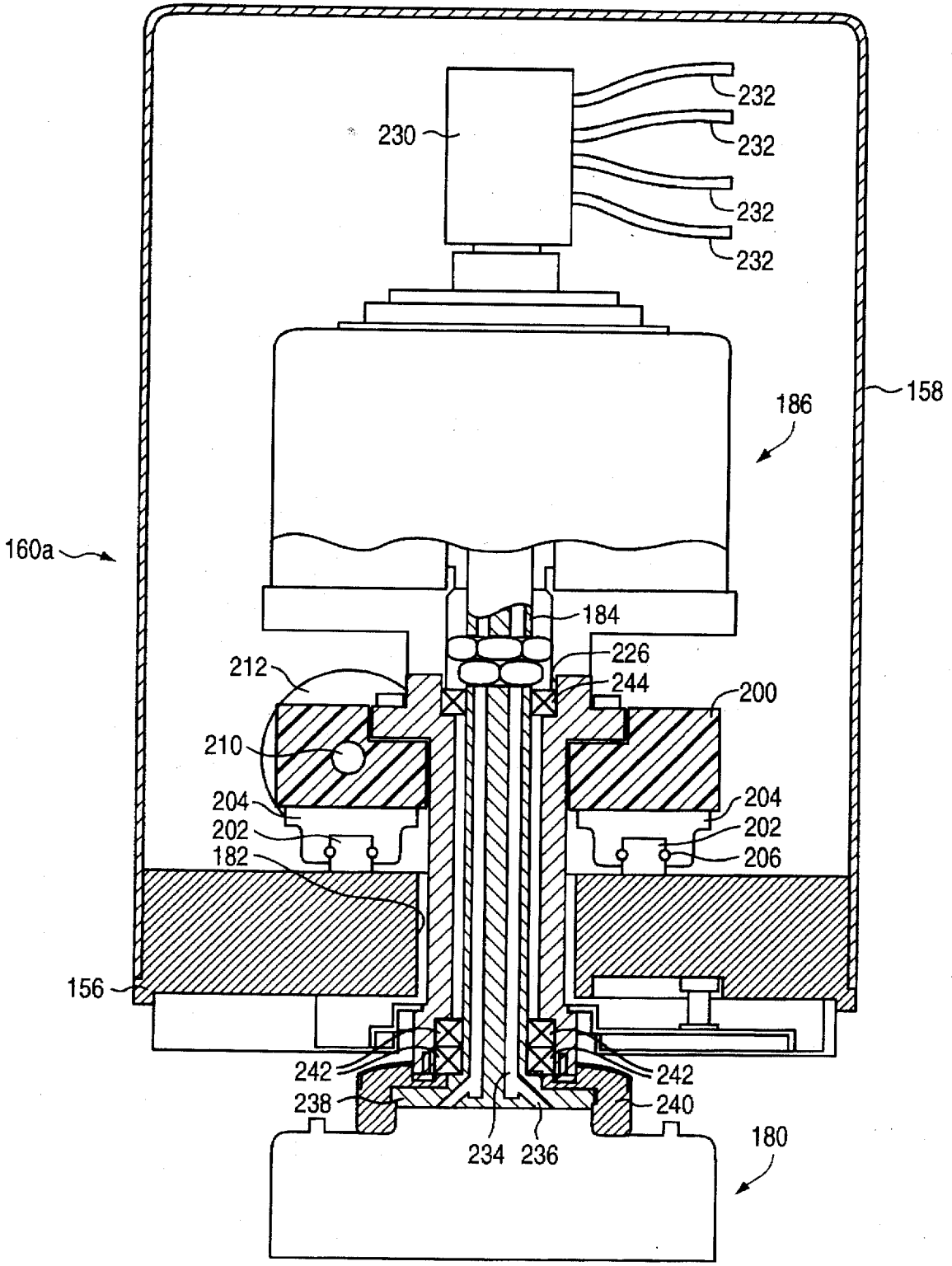
FIG. 8 is a cross-sectional view of the carrier head of FIG. 7 along line 8—8.

As shown in both FIGS. 7 and 8, each linear bearing assembly 201 includes a rail 202 fixed to support plate 156, and two hands 204 (only one of which is illustrated in FIG. 8) fixed to slide 200 which grasps the rail. A bearing 206 separates each hand 204 from rail 202 to provide free and smooth movement therebetween. Thus, the linear bearing assemblies permit the slides 200 to move freely along slots 182.

A bearing stop 208 anchored to the outer end of one of the rails 202 prevents slide 200 from accidentally coming off the end of the rails. One of the arms of each slide 200 contains an unillustrated threaded receiving cavity or nut fixed to the slide near its distal end. The threaded cavity or nut receives a worm-gear lead screw 210 driven by a slide radial oscillator motor 212 mounted on support plate 156. When motor 212 turns lead screw 210, slide 200 moves radially. The four motors 212 are independently operable to independently move the four slides 200 along the slots 182 in carrousel support plate 156.

Each slide 200 is associated with an optical position sensor 224. An angle iron 220 having a horizontally extending wing 222 is attached to the worm side of each slide 200. Optical position sensor 224 is fixed to support plate 156. The height of sensor 224 is such that wing 222 passes through the two jaws of the sensor 224, and the linear position of sensor 224 along slot 182 is such that wing 222 passes from one side of sensor 224 to the other when slide 200 moves from its radially innermost position to its radially outermost position. Although the slide position is monitored by the input to motor 212 or an encoder attached thereto, such monitoring is indirect and accumulates error. The optical position sensor 224 calibrates the electronic monitoring and is particularly useful when there has been a power outage or similar loss of machine control.

A carrier head assembly, each including a carrier head 180, a carrier drive shaft 184, a carrier motor 186, and a surrounding non-rotating shaft housing 226, is fixed to each of the four slides 200. Drive shaft housing 226 holds drive shaft 184 by paired sets of lower ring bearings 242 and a set of upper ring bearings 244. Each carrier head assembly can be assembled away from polishing apparatus 80, slid in its untightened state into slot 182 in carousel support plate 156 and between the arms of slide 200, and there tightened to grasp the slide.

A rotary coupling 230 at the top of drive motor 186 couples four fluid or electrical lines 232 into four channels 234 in drive shaft 184 (only two channels are shown because FIG. 8 is a cross-sectional view). Angled passages 236 formed in a base flange 238 of drive shaft 184 connect the four channels 234 to receiving channels in carrier head 180. Channels 234 are used, as described in more detail below, to pneumatically power carrier head 180, to control the temperature of the carrier head, and to vacuum-chuck the substrate to the bottom of the carrier head.

Figure 9:
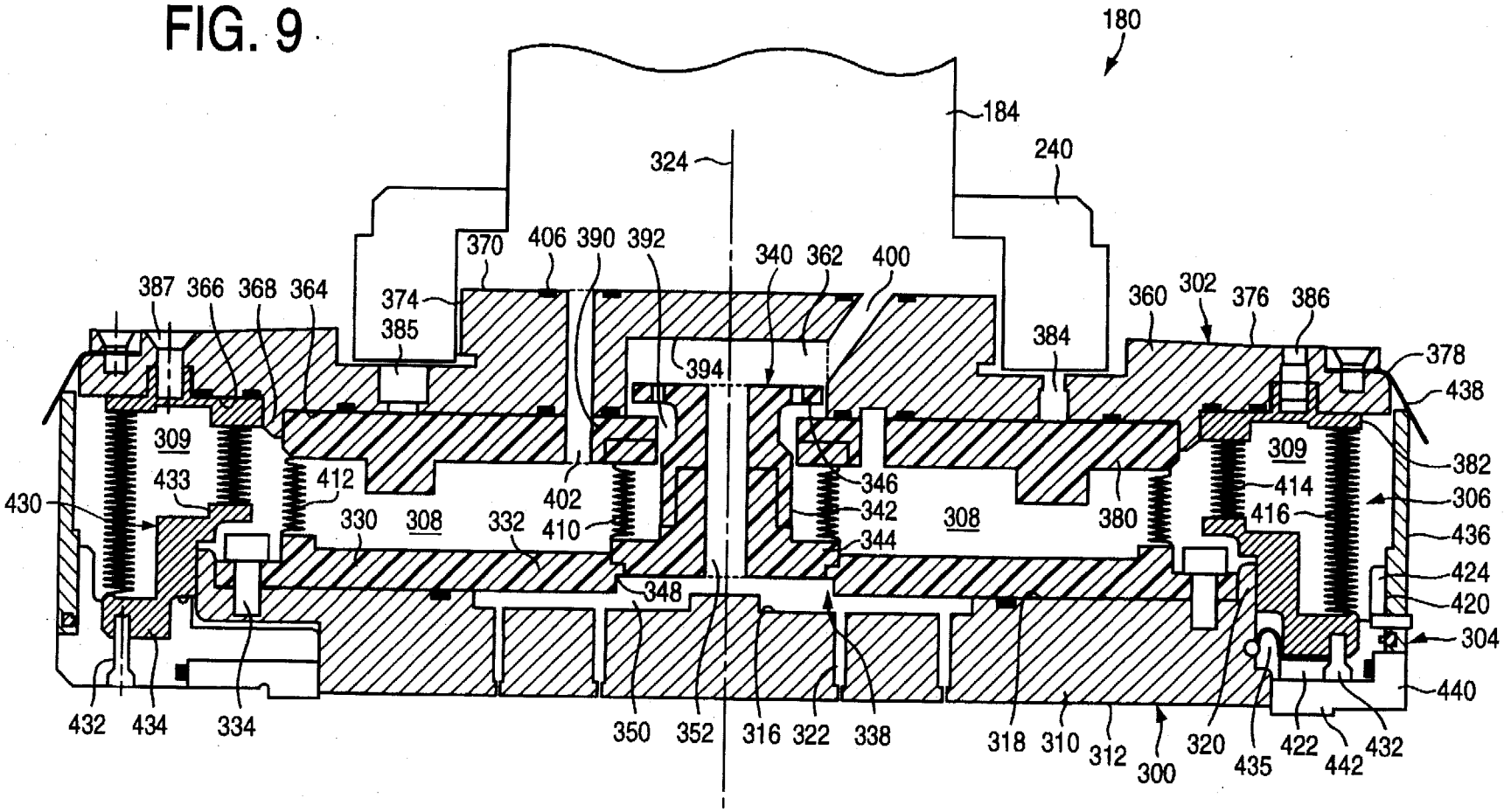
FIG. 9 is a schematic cross-sectional view of a carrier head in accordance with the present invention.

As shown in in FIG. 9, carrier head 180 comprises three major assemblies: a base assembly 300, a housing assembly 302, and a retaining ring assembly 304. A bellows system 306 is positioned between the housing assembly and the base and retaining ring assemblies. Each of these assemblies is explained in detail below. The right half of FIG. 9 shows a carrier head configured for an eight-inch diameter substrate, whereas the left half of FIG. 9 shows a carrier head configured for a six-inch diameter substrate. The two configurations are substantially similar, but differ in the shape of components of retaining ring assembly 304.

Base assembly 300 applies a load to substrate 10; that is, it pushes substrate 10 against polishing pad 120. Base assembly 300 can move vertically with respect to housing assembly 302 to carry the substrate to and from the polishing pad. Bellows system 306 connects housing assembly 302 to base assembly 300 to create a primary pressure chamber 308 therebetween. Fluid, preferably air, is pumped into and out of primary pressure chamber 308 to control the load on substrate 10. When air is pumped into primary pressure chamber 308, the pressure in the chamber increases and base assembly 300 is pushed downwardly.

Bellows system 306 also connects housing assembly 302 to retaining ring assembly 304 to create a secondary pressure chamber 309. Fluid, preferably air, is pumped into and out of secondary pressure chamber 309 to control the load on the retaining ring.

As explained below, housing assembly 302 is connected to and rotated by drive shaft 184. When housing assembly 302 rotates, bellows system 306 transfers torque from housing assembly 302 to base assembly 300 and retaining ring assembly 304, and causes them to rotate. However, because the bellows are flexible, the base assembly and retaining ring assembly can independently pivot with respect to the housing assembly in order to remain substantially parallel with the surface of the polishing pad.

Base assembly 300 includes a disk-shaped carrier base 310 having a nearly flat bottom surface 312 which may contact substrate 10. A top surface 314 of carrier base 310 may include an asterisk-shaped depression 316 having six spokes. Depression 316 is surrounded by an annular area 318. Annular area 318 is itself surrounded by a rim 320. Several conduits 322, evenly spaced about a central axis 324 of carrier head 180, extend through carrier base 310 from bottom surface 312 to depression 316. Preferably, two conduits descend vertically from each spoke of the depression to the bottom surface.

A generally flat annular plate 330 rests primarily on annular area 318, with the outer edge of the annular plate abutting rim 320 of carrier base 310. An inner portion 332 of the annular plate projects over circular depression 316. Annular plate 330 may be attached to carrier base 310 by screws 334 which extend through passages in the annular plate and engage threaded recesses in the carrier base.

A stop cylinder 340 is mounted in a central opening 338 in annular plate 330. Stop cylinder 340 includes a tubular body 342, a radially projecting lower flange 344, and a radially projecting upper flange 346. Lower flange 344 is welded to a lip 348 at the inner edge of annular plate 330 to support stop cylinder 340 above the annular plate. The gap between circular depression 316 of carrier base 310 and lower flange 344 of stop cylinder 340 and inner portion 332 of annular plate 330 creates a cavity 350 in base assembly 300. A central channel 352 extends through tubular body 342 from lower flange 344 to upper flange 346 to provide a fluid pathway to cavity 350 and conduits 322. Stop cylinder 340 may be formed of a top portion which is screwed onto a bottom portion. Spacers may be inserted into a gap between the top and bottom portions to control the length of the stop cylinder.

Housing assembly 302 includes a disk-shaped carrier housing 360. The bottom surface of carrier housing 360 has a cylindrical cavity 362. The carrier bottom surface also includes an inner annular surface 364 and an outer annular surface 366 separated by a ridge 368. The top surface of carrier housing 360 includes a cylindrical hub 370 with a threaded neck 374 which projects above an annular area 372. A gently-sloped section 376 surrounds annular area 372, and a ledge 378 surrounds sloped section 376.

Housing assembly 302 further includes an annular inner plate 380 and an annular outer plate 382. Inner plate 380 is connected to inner annular surface 364 on the bottom of carrier housing 360 by pins 384 and couterbore screws 385, and outer plate 382 is similarly mounted to outer annular surface 366 by pins 386 and counterbore screws 387. Preferrably, five pins and five screws connect each plate to the carrier housing. The outer edge of inner plate 380 abuts ridge 368. The inner edge of inner plate 380 projects horizontally under cylindrical cavity 362 to form an inwardly pointing lip 390 surrounding an opening 392. The top of cylindrical cavity 362 is closed by a ceiling 394. Stop cylinder 340 of base assembly 300 extends through opening 392 into cylindrical cavity 362, and upper flange 346 projects horizontally over lip 390.

There are several conduits in housing assembly 302 to provide for fluid flow into and out of the carrier head. A first conduit 400 extends from cylindrical cavity 362 through carrier housing 360 to hub 370. A second conduit 402 extends from the bottom surface of inner plate 380, through carrier housing 360, to hub 370. A third conduit 404 (see FIG. 10) extends from the bottom surface of outer plate 382 through carrier housing 360 to hub 370. An O-ring 406 inset into the top surface of hub 370 surrounds each conduit.

Carrier head 180 may be attached to drive shaft 184 by placing two dowel pins (not shown) into dowel pin holes (not shown) and lifting the carrier head so that the dowel pins fit into paired dowel pin holes (not shown) in drive shaft flange 238. This aligns angled passages 236 to the conduits 400, 402 and 404. In operation, the dowl pins transfer torque from the drive shaft to the housing assembly so that the housing assembly rotates with the drive shaft. Then threaded perimeter nut 240 can be screwed onto threaded neck 374 to attach carrier head 180 firmly to drive shaft 184.

Figure 10:
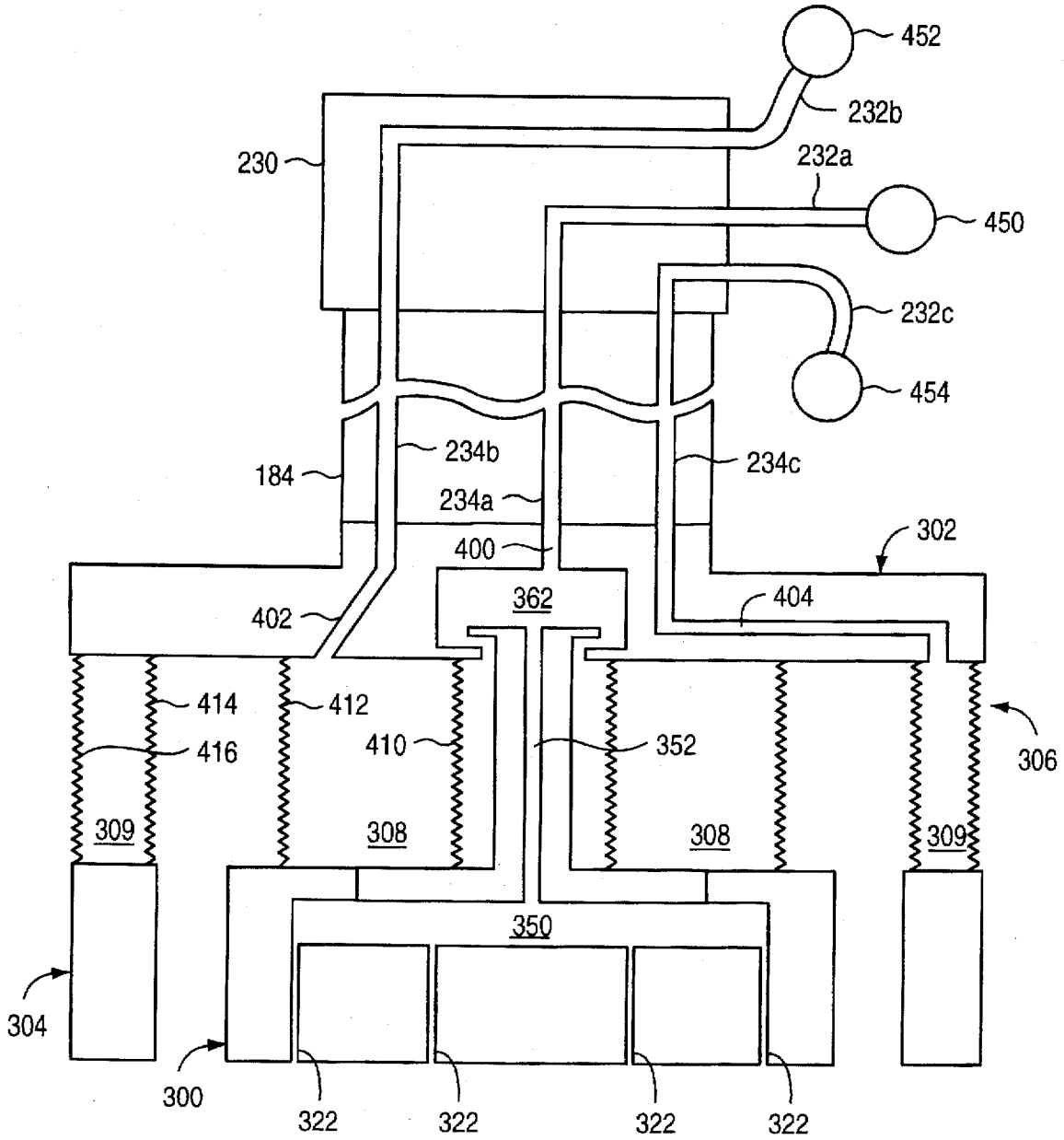
FIG. 10 is a schematic diagram of the fluid lines for the carrier head of the present invention.

Bellows system 306 includes several cylindrical metal bellows disposed concentrically in the space between base assembly 300 and housing assembly 302. Each bellows can expand and contract vertically. An inner bellows 410 connects the inner edge of inner plate 380 and to lower flange 344 of stop cylinder 340 to seal cavity 362 and central channel 352 from primary pressure chamber 308. As shown in FIG. 10, a pump 450 can pump air into or out of conduits 322 through a line **232*a*, a channel 234*a* in drive shaft 184, first conduit 400, cavity 362, central channel 352, and cavity 350**. If air is pumped out of the conduits, the substrate will be vacuum-chucked to the bottom surface of the carrier head. If air is pumped into the conduits, the substrate will be pressure-ejected from the bottom surface of the carrier head.

Returning to FIG. 9, outer bellows 412 connects the outer edge of inner plate 380 to annular plate 330. The ring-shaped space between concentric inner bellows 410 and outer bellows 412 forms primary pressure chamber 308. As shown in FIG. 10, a pump 452 can pump a fluid, preferably air, into or out of primary pressure chamber 308 through a line **232*b*, a channel 234*b* in drive shaft 184, and second conduit 402. If fluid is pumped into primary chamber 308, the volume of the chamber will expand until substrate 10 beneath base assembly 300 contacts the surface of the polishing pad. Forcing additional fluid into the primary chamber will increase the pressure and thus increase the downward pressure on substrate 10. Pump 452** may adjust the pressure in the primary pressure chamber and thus the load on the substrate.

Referring to FIG. 9, when primary pressure chamber 308 expands and base assembly 300 moves downwardly with respect to housing assembly 302, metal bellows 410 and 412 stretch to accommodate the increased distance between annular plate 330 and inner plate 380. However, flange 346 of stop cylinder 340 will catch against lip 390 of housing assembly 302 to stop the downward motion of the base assembly and prevent the bellows from over-extending and becoming damaged.

Retaining ring assembly 304 includes an L-shaped ring support 420 with a inwardly directed horizontal arm 422 and an upwardly directed vertical arm 424. A backing ring 430 is attached to the top of horizontal arm 422 by screws 432. An outer portion 433 of backing ring abuts vertical arm 424, and an inner portion 434 of backing ring 430 may project horizontally over rim 320 of carrier base 310. A flexible seal 435 connects retaining ring assembly 304 to carrier base 310 to protect the carrier head from slurry. The outer edge of seal 435 is pinched between horizontal arm 422 and backing ring 430. The inner edge of seal 435 is an O-ring having a smaller radius than the carrier base. The O-ring fits elastically into a notch in carrier base 310 to hold the inner edge of seal 435 in place. A flange 436 is attached to the outside of vertical arm 424 and forms the outer wall of carrier head 180. Flange 436 extends upwardly to almost touch carrier housing 360. A seal 438 rests on ledge 378 and extends over flange 436 to protect carrier head 180 from contamination by slurry. A retaining ring 440 is mounted to the bottom surface of horizontal arm 422 a O-ring which fits partially into a notch in ring support 420. Retaining ring 440 includes a protruding portion 442 which will contact polishing pad 120 and block substrate 10 from slipping out from under base assembly 300.

A third bellows 414 connects the inner edge of outer plate 382 of housing assembly 302 to the inner portion 433 of backing ring 430. A fourth bellows 416 connects the outer edge of outer plate 382 to the outer portion 433 of backing ring 430. The ring-shaped space between concentric third and fourth bellows 414 and 416 forms secondary pressure chamber 309. As shown in FIG. 10, a pump 454 can pump fluid, preferrably air, into or out of secondary pressure chamber 309 through a line 232*c*, a channel 234*c* in drive shaft 184, and third conduit 404. If fluid is pumped into secondary chamber 309, the volume of the chamber will expand until retaining ring 440 contacts the surface of the polishing pad. Forcing additional fluid into the secondary chamber will increase the pressure in the secondary pressure chamber will thus increase the downward pressure on retaining ring 440. Because the primary and secondary chambers are pressurized independently, the base assembly and retaining ring can be independently actuated.

Carrier head 180 may use two presassembled bellows assemblies. Inner bellows 410 and outer bellows 412 are welded to inner plate 380 and annular plate 330 to form the first bellows assembly, and third bellows 414 and fourth bellows 416 are welded to outer plate 382 and backing ring 430 to form the second bellows assembly. The two bellows assemblies are dropped onto housing 360 and attached by screws and pins as discussed above. Then carrier base 310 and ring support 422 may be attached.

In summary, the carrier head of the present invention uses multiple bellows to form two pressure chambers between the housing and carrier base and retaining ring assembly. By pressurizing the first chamber, an even load can be applied across the substrate. By pressurizing the secondary chamber, the retaining ring can pressed against the polishing pad. The bellows allow the carrier base to pivot with respect to the housing, but the downward force is evenly applied to the substrate through the first pressure chamber. Torque is transferred from the carrier housing to the carrier base through the bellows.

The present invention has been described in terms of a preferred embodiment. The invention, however, is not limited to the embodiment depicted and described. Rather, the scope of the invention is defined by the appended claims.

What is claimed is:

1. A carrier head for chemical mechanical polishing, comprising:

a housing connectable to a drive shaft to rotate with said drive shaft;

a base to hold a substrate against a polishing pad;

a retaining ring surrounding said base to hold said substrate beneath said base;

a plurality of bellows connecting said base to said housing to form a first chamber therebetween and connecting said retaining ring to said housing to form a second chamber therebetween.

2. The carrier head of claim 1 wherein said plurality of bellows comprises first and second bellows connecting said base to said housing, and third and fourth bellows connecting said retaining ring to said housing.

3. The carrier head of claim 1 wherein said base includes a first surface to contact against a second surface on said housing to prevent over-extension of at least some of said plurality of bellows.

4. The carrier head of claim 3 wherein said housing includes a cavity and said second surface is located in said cavity, said base includes a rod which extends into said cavity, said rod has an outwardly projecting flange, and said first surface is located on said flange.

5. The carrier head of claim 1 wherein said plurality of bellows forms a third chamber between said base and said housing, and said base includes a passage connecting a bottom surface of said base to said third chamber.

6. The carrier head of claim 1 further comprising a flexible seal connecting said base to said retaining ring.

7. An apparatus for use in chemical mechanical polishing, comprising:

a housing connectable to a drive shaft to rotate with said drive shaft about a first axis;

a base having a surface to hold a substrate against a polishing pad;

a retaining ring surrounding said base and having a projection to hold said substrate beneath said base;

a plurality of bellows connecting said base to said housing to form a first chamber therebetween and connecting said retaining ring to said housing to form a second chamber therebetween;

a first pump to pressurize said first chamber to cause said surface of said base to press said substrate against said polishing pad; and a second pump to pressurize said second chamber to cause said projection to press against said polishing pad.

8. The apparatus of claim 7 wherein said plurality of bellows forms a third chamber between said base and said housing, and said base includes a plurality of passages connecting said surface to said third chamber, and said apparatus further comprises a third pump connected to said third chamber to force air through said passages.

* * * * *

UNITED STATES PATENT AND TRADEMARK OFFICE

CERTIFICATE OF CORRECTION

PATENT NO. : 5,681,215

DATED : 10/28/97

INVENTOR(S) : Sherwood et al.

It is certified that error appears in the above-identified patent and that said Letters Patent is hereby corrected as shown below:

On Title sheet References Cited
U.S. Patent documents, add References Cited by PTO to read

| | | | |
|---|---|---|---|
| -- | 3,708,921 | 1/73 | P. Cronkhite et al. |
| | 4,918,869 | 4/90 | S. Kitta |
| | 5,441,444 | 8/95 | M. Nakajima |
| | 5,476,414 | 12/95 | M. Hirose et al.-- |

Signed and Sealed this

Thirteenth Day of June, 2000

*Attest:*

Q. TODD DICKINSON

*Attesting Officer*

*Director of Patents and Trademarks*